US010232630B2

(12) United States Patent
Quinn et al.

(10) Patent No.: US 10,232,630 B2
(45) Date of Patent: Mar. 19, 2019

(54) ELECTRONIC PATCH FOR REFURBISHING A USED PRINT CARTRIDGE

(71) Applicant: CLOVER TECHNOLOGIES GROUP, LLC, Ottawa, IL (US)

(72) Inventors: Andrew J. Quinn, St. Johns, MI (US); Steven D. Iocco, St. Johns, MI (US)

(73) Assignee: CLOVER TECHNOLOGIES GROUP, LLC, Ottawa, IL (US)

( * ) Notice: Subject to any disclaimer, the term of this patent is extended or adjusted under 35 U.S.C. 154(b) by 24 days.

(21) Appl. No.: 15/407,629

(22) Filed: Jan. 17, 2017

(65) Prior Publication Data

US 2017/0120611 A1 May 4, 2017

Related U.S. Application Data

(63) Continuation of application No. 15/229,306, filed on Aug. 5, 2016, now Pat. No. 9,573,378, which is a continuation of application No. 14/174,056, filed on Feb. 6, 2014, now Pat. No. 9,421,783.

(60) Provisional application No. 61/763,589, filed on Feb. 12, 2013.

(51) Int. Cl.
*B41J 2/175* (2006.01)

(52) U.S. Cl.
CPC ..... *B41J 2/17543* (2013.01); *B41J 2/1753* (2013.01); *B41J 2/17526* (2013.01); *B41J 2/17546* (2013.01); *B41J 2/17559* (2013.01)

(58) Field of Classification Search
CPC ..... B41J 2/17559; B41J 2/1753
See application file for complete search history.

(56) References Cited

U.S. PATENT DOCUMENTS

| | | | |
|---|---|---|---|
| 5,345,315 | A | 9/1994 | Shalit |
| 6,149,857 | A | 11/2000 | McArdle et al. |
| 6,161,915 | A | 12/2000 | Bolash et al. |
| 6,325,475 | B1 | 12/2001 | Hayes et al. |
| 6,379,876 | B1 | 4/2002 | Irving et al. |

(Continued)

FOREIGN PATENT DOCUMENTS

| | | |
|---|---|---|
| CN | 201208811 | 3/2009 |
| EP | 1201441 A1 | 5/2002 |

(Continued)

OTHER PUBLICATIONS

"Intervene." Merriam-Webster.com. Merriam-Webster, n.d. Web. Sep. 5, 2017.*

(Continued)

*Primary Examiner* — Manish S Shah
*Assistant Examiner* — Jeffrey C Morgan
(74) *Attorney, Agent, or Firm* — Matthew G. Gavronski; Clover Technologies Group, LLC

(57) ABSTRACT

Devices and methods for refurbishing a used print cartridge for further use in a printing device are provided. An electronic patch is attached to a circuit on the used print cartridge. The electronic patch includes contact pads that are positioned to correspond to the location of contact pads on the circuit of the used print cartridge. The electronic patch also includes a control chip and an embedded memory array that replaces one or more functions of the memory on the used print cartridge, allowing the used print cartridge to be refilled with printing ink and reused in a printer.

16 Claims, 12 Drawing Sheets

(56) References Cited

U.S. PATENT DOCUMENTS

| | | | |
|---|---|---|---|
| 6,402,876 | B1 | 6/2002 | McArdle et al. |
| 6,509,126 | B1 | 1/2003 | Whitesides et al. |
| 6,837,565 | B2 | 1/2005 | Studholme et al. |
| 6,882,810 | B2 | 4/2005 | Karagiannis et al. |
| 7,027,660 | B2 | 4/2006 | Hersch et al. |
| 7,139,493 | B2 | 11/2006 | Ito et al. |
| 7,207,483 | B2 | 4/2007 | Silverbrook et al. |
| 7,254,346 | B2 | 8/2007 | Burchette et al. |
| 7,289,156 | B2 | 10/2007 | Silverbrook et al. |
| 7,328,974 | B2 | 2/2008 | Wang |
| 7,483,053 | B2 | 1/2009 | Silverbrook |
| 7,515,837 | B2 | 4/2009 | Thacker et al. |
| 7,640,181 | B2 | 12/2009 | McClure et al. |
| 7,875,463 | B2 | 1/2011 | Adaskin et al. |
| 7,894,729 | B2 | 2/2011 | Cho et al. |
| 7,971,947 | B2 | 7/2011 | Burchette |
| 7,988,257 | B2 | 8/2011 | Jung et al. |
| 8,061,826 | B2 | 11/2011 | Lewis et al. |
| 8,160,473 | B2 | 4/2012 | Swartz et al. |
| 8,171,567 | B1 | 5/2012 | Fraser et al. |
| 8,259,351 | B2 | 9/2012 | Kuwahara |
| 8,262,201 | B2 | 9/2012 | Brocklin et al. |
| 8,287,204 | B2 | 10/2012 | Silverbrook et al. |
| 8,297,868 | B2 | 10/2012 | Underwood et al. |
| 2002/0024570 | A1 | 2/2002 | Childers et al. |
| 2005/0036801 | A1* | 2/2005 | Burchette ..... G03G 21/1875 399/109 |
| 2006/0053030 | A1 | 3/2006 | Nakamura et al. |
| 2007/0263044 | A1 | 11/2007 | Nip |
| 2007/0297828 | A1* | 12/2007 | Causey ..... G03G 21/181 399/109 |
| 2008/0253799 | A1 | 10/2008 | Causey |
| 2009/0058958 | A1 | 3/2009 | Wang |
| 2009/0153602 | A1* | 6/2009 | Brown ..... B41J 2/17546 347/7 |
| 2011/0085310 | A1 | 4/2011 | Cachia et al. |
| 2011/0128567 | A1 | 6/2011 | Cachia et al. |

FOREIGN PATENT DOCUMENTS

| | | | |
|---|---|---|---|
| EP | 1247651 | A2 | 10/2002 |
| EP | 3115214 | A1 | 1/2017 |
| WO | 2005081072 | A1 | 9/2005 |
| WO | 2011018003 | A1 | 2/2011 |

OTHER PUBLICATIONS

Notice of opposition to a European patent, dated May 16, 2017, 33 pages, European Patent Office, Munich, Germany.

International Search Report and Written Opinion, International Application No. PCT/US2014/015046, dated Jul. 3, 2014, 10 pages, European Patent Office, HV Rijswijk, NL-2280.

* cited by examiner

ELECTRONIC PATCH FOR REFURBISHING A USED PRINT CARTRIDGE

CROSS-REFERENCE TO RELATED APPLICATIONS

This is a continuation of U.S. patent application Ser. No. 15/229,306, filed Aug. 5, 2016, which is a continuation of U.S. patent application Ser. No. 14/174,056, filed Feb. 6, 2014, now U.S. Pat. No. 9,421,783, which claims the benefit of and priority to U.S. Provisional Patent Application No. 61/763,589, filed Feb. 12, 2013. The entire contents of each of the foregoing documents are hereby incorporated by reference herein.

FIELD OF THE INVENTION

The present disclosure relates to methods and devices for repairing or refurbishing a used print cartridge for further use in a printing device. More particularly, the present disclosure relates to an electronic patch configured to provide memory array functions that replace or add to inoperable memory array functions of the used print cartridge.

BACKGROUND

Print cartridges used in printer devices such as printers typically have one or two dimensional internal memory arrays. The memory arrays are used to store critical printing parameters that are used throughout the life cycle of the print cartridge, and may be embedded in the silicon die of the print cartridge. For example, the silicon die may be underneath the orifice plate that includes the nozzles of the print head. The printing parameters help ensure quality and proper operation of the printer, such as by tracking ink levels, for example. Running a dry print cartridge can damage the printing device (e.g., printer) in which the print cartridge is installed. When a print cartridge or ink pen is installed in an inkjet printer, the printer reads the printing parameters from the memory arrays embedded in the print cartridge.

The printer also programs information to the internal or embedded memory of the print cartridge. The programming process may be implemented by programming, burning, or damaging a specific memory location that contains a simple electrical fuse or a FET by coding in a 0 or 1 bit at the specific memory location. During operation of the printer cartridge, memory locations are programmed, burned, or damaged throughout the life cycle of the print cartridge. For example, when the ink levels in a print cartridge are completely depleted, the memory locations that control the monitoring of the ink levels may be programmed (e.g., burned), thereby making the memory locations unable to be reset if it is a one-time programmable memory or fuse. Thus, the user may discard the print cartridge in the garbage and purchase a new print cartridge for use with the printer. This is both costly for the user and wasteful of resources as perfectly useable depleted print cartridges are disposed of in the landfill and additional raw materials and energy expenditures are required to manufacture the new print cartridges. Although the print cartridge still has a useful life for printing, and may be refilled with ink, unless proper information about the amount of ink in the refilled print cartridge is provided to the printer, the printer may not function properly.

SUMMARY

For proper operation of refurbished or refilled print cartridges in the printer, the refurbished print cartridge may be modified to include a patch that replaces non-functional electrical elements of the used print cartridge, such as damaged embedded memory arrays. In this regard, the present disclosure provides devices and methods for refurbishing or repairing a used print cartridge for further use in a printing device.

In one embodiment, an electronic patch assembly for use on a print cartridge is provided. The electronic patch assembly includes a patch circuit. The patch circuit includes a substrate, a plurality of lead lines, a plurality of contact pads, and an integrated chip having an embedded memory array. The position of the contact pads are configured to correspond with a contact pad pattern of a print cartridge electrical circuit.

The electronic patch assembly may also include wherein the patch circuit is one of a second flexible circuit and a printed circuit board (PCB) and wherein the embedded memory array is configured to replace memory functions of one or more memory locations of the print cartridge. The electronic patch assembly may further include wherein the embedded memory array is configured to add additional memory functions to the print cartridge. The electronic patch assembly may also include wherein the embedded memory array is configured to store information relating to at least one of the production date, the ink container size, the age of the ink, the regional settings, the cartridge identification number and the ink levels. The electronic patch assembly may further include an adhesive material, wherein the adhesive material is positioned on portions of one surface of the patch circuit. The electronic patch assembly may further include wherein the integrated chip is one of a microcontroller, an application specific integrated circuit (ASIC) and a field programmable gate array (FPGA)

In another embodiment, a print cartridge assembly is provided. The print cartridge assembly includes a print cartridge and an electronic patch assembly. The print cartridge may include a housing, a cap, a cartridge electrical circuit having first lead lines and first contact pads, a print head and a silicon die having a first embedded memory array. The electronic patch assembly may include a patch circuit having second lead lines and second contact pads, an integrated chip having a second embedded memory array, wherein a portion of the electronic patch is attached to the print cartridge over a portion of the cartridge electrical circuit, and wherein the position of the second contact pads are configured to be in electrical contact with one or more of the first contact pads.

The print cartridge assembly may also include wherein the patch circuit is one of a second flexible circuit and a printed circuit board (PCB) and wherein the second embedded memory array is configured to replace memory functions of one or more memory locations of the first embedded memory array. The print cartridge assembly may further include wherein the second embedded memory array is configured to store information relating to at least one of the production date, the ink container size, the age of the ink, the regional settings, the cartridge identification number and the ink levels. The print cartridge assembly may also include wherein the print cartridge is a used print cartridge and the print cartridge assembly is a refurbished print cartridge. The print cartridge assembly may further include an identification label.

In yet another embodiment, a method of refurbishing a print cartridge assembly is provided. The method includes obtaining a used print cartridge assembly. The method also includes adding new printing ink to the used print cartridge assembly. The method further includes positioning an electronic patch over a portion of a cartridge electrical circuit on the used print cartridge assembly, wherein one or more contact pads on the electronic patch are in electrical contact with one or more contact pads on the cartridge electrical circuit. The method also includes attaching the electronic patch to the used print cartridge assembly.

The method may also include cleaning the used print cartridge assembly. The method may further include testing the refurbished print cartridge assembly. The method may also include attaching an identification label to the used print cartridge assembly. The method may further include storing in a memory array of the electronic patch at least one of the production date, the ink container size, the age of the ink, the regional settings, the cartridge identification number and the ink levels.

In other embodiments, an electronic patch assembly for use on a print cartridge may be provided. The print cartridge may have a cartridge circuit with a plurality of cartridge contact pads arranged in a pattern. The electronic patch assembly may include a substrate securable to the print cartridge and a patch circuit coupled to the substrate. A plurality of patch contact pads may be provided on the substrate. At least some of the patch contact pads may be arranged to correspond with the pattern. The plurality of patch contact pads may include a pass through contact pad that allows electrical signals to pass through to the first circuit when the substrate is secured to the print cartridge, and a replacement contact pad that routes electrical signals to the patch circuit.

In some aspects, the patch circuit may include memory associated with the replacement contact pad. The memory may include an embedded memory array that replaces non-functional memory associated with the cartridge circuit. The memory may store ink level information. The substrate may include a front side that faces away from the print cartridge when the substrate is secured to the print cartridge, and a back side that faces toward the print cartridge when the substrate is secured to the print cartridge, and wherein the plurality of patch contact pads are provided on the front side of the substrate. The electronic patch assembly may further include a plurality of solder locations provided on the back side of the substrate and arranged to correspond with the pattern. Each solder location may electrically communicate with a respective one of the plurality of patch contact pads. The patch circuit may include a control chip that is coupled to the back side of the print cartridge. The control chip may be one of a microcontroller, an application specific integrated circuit (ASIC) and a field programmable gate array (FPGA). The plurality of patch contact pads may include programming contact pads in electrical communication with the patch circuit and not corresponding to the pattern.

In still other embodiments, a print cartridge assembly is provided and may include a print cartridge having a cartridge circuit with a plurality of cartridge contact pads arranged in a pattern. The cartridge circuit may include at least one non-functional circuit element. An electronic patch assembly may be coupled to the cartridge and electrically communicate with the cartridge circuit. The electronic patch assembly may include a substrate coupled to the print cartridge and a plurality of patch contact pads provided on the substrate. At least some of the patch contact pads may be arranged to correspond with the pattern and may be in electrical communication with a respective one of the cartridge contact pads. A patch circuit may be coupled to the substrate and may electrically communicate with at least some of the plurality of patch contact pads. The patch circuit may include a replacement circuit element for replacing the non-functional circuit element of the cartridge circuit.

In some aspects, the non-functional circuit element may include a memory location of a first embedded memory array of the cartridge circuit, and the replacement circuit element may include a memory location of a second embedded memory array of the patch circuit. The second embedded memory array may be configured to store information relating to at least one of the production date, the ink container size, the age of the ink, the regional settings, the cartridge identification number and the ink levels. The plurality of patch contact pads includes a pass through contact pad that allows electrical signals to pass without interruption through the electronic patch assembly to the cartridge circuit, and a replacement contact pad that routes electrical signals to the replacement circuit element. The substrate may include a front side facing away from the print cartridge and a back side facing toward the print cartridge. The plurality of patch contact pads may be on the front side of the substrate. The electronic patch assembly may further include a plurality of solder locations provided on the back side of the substrate, where each solder location is located opposite a respective one of the plurality of patch contact pads and is coupled to a respective one of the plurality of cartridge contact pads. The print cartridge may include a front face to which the electronic patch assembly is coupled, the front face may have a recess formed therein, and the recess may receive a portion of the patch circuit. The plurality of cartridge contact pads may include a cartridge contact pad for receiving operating signals and a cartridge contact pad for receiving information signals. The pass through contact pad may be in electrical communication with the cartridge contact pad for receiving operating signals, and the replacement contact pad may be in electrical communication with the cartridge contact pad for receiving information signals. The print cartridge may be a used print cartridge and the print cartridge assembly may be a refurbished print cartridge.

In still other embodiments, a print cartridge assembly is provided and may include a used print cartridge having a front face and including a cartridge circuit with a plurality of cartridge contact pads. The cartridge circuit may include at least one non-functional circuit element, and the front face may have a recess formed therein. An electronic patch assembly may be coupled to the cartridge and may electrically communicate with the cartridge circuit. The electronic patch assembly may include a substrate coupled to the front face of the print cartridge. The substrate may have a front side facing away from the print cartridge and a back side facing toward the print cartridge. The patch assembly may also include a patch circuit including a control chip and a replacement circuit element for replacing the non-functional circuit element of the cartridge circuit. The control chip may extend from the back side of the substrate and be received within the recess. A plurality of patch contact pads may be provided on the front side of the substrate. At least some of the patch contact pads may be in electrical communication with the patch circuit. A plurality of solder locations may be provided on the back side of the substrate, with each solder location being in electrical communication with a respective one of the patch contact pads and further being electrically and mechanically coupled to a respective one of the cartridge contact pads, thereby electrically coupling certain ones of the cartridge contact pads with respective ones of the patch contact pads. The plurality of patch contact pads may include at least one pass through contact pad that allows electrical signals to pass without interruption through the electronic patch assembly to the cartridge circuit, and at least one replacement contact pad that routes electrical signals to the replacement circuit element.

In some aspects, the plurality of cartridge contact pads may include a cartridge contact pad for receiving operating signals and a cartridge contact pad for receiving information signals. The at least one pass through contact pad may be in electrical communication with the cartridge contact pad for receiving operating signals, and the at least one replacement contact pad may be in electrical communication with the cartridge contact pad for receiving information signals. The non-functional circuit element may include a memory location of a first embedded memory array of the cartridge circuit, and the replacement circuit element may include a memory location of a second embedded memory array of the patch circuit.

DETAILED DESCRIPTION

Figure 1:
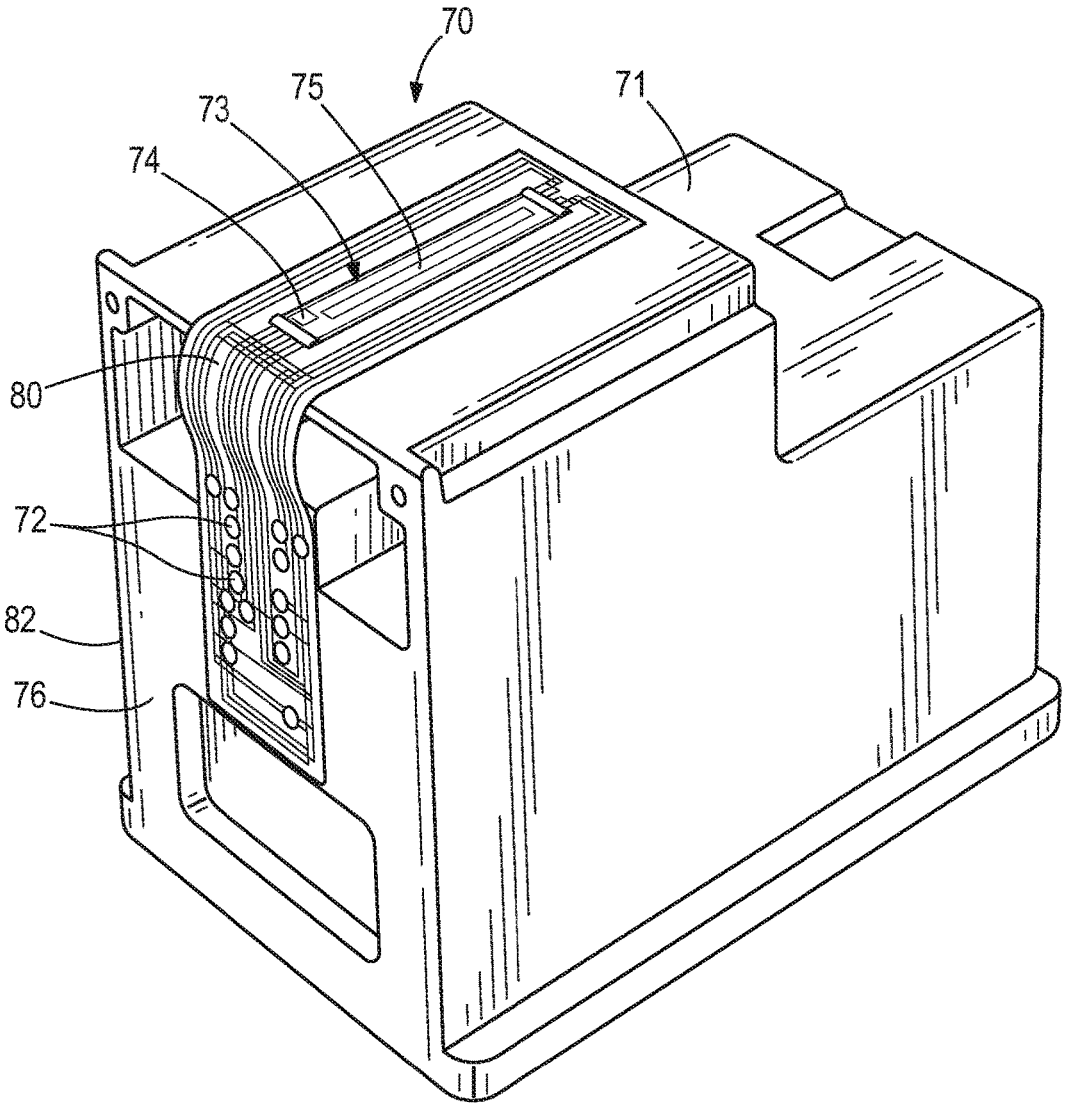
FIG. 1 is a front perspective view of an exemplary print cartridge.

While the subject matter of this disclosure can be practiced and carried out in many different ways, certain specific embodiments are shown in the drawings and described in detail with the understanding that such drawings and description are exemplary in nature and are not intended to limit the scope of the invention set forth in claims only to those embodiments that are illustrated and described.

FIG. 1 illustrates an exemplary print cartridge 70, such as an ink jet print head cartridge. The print cartridge 70 includes a first circuit in the form of a cartridge electrical circuit 80. The cartridge electrical circuit 80 acts as an electronic interface between a printer controller associated with a printing device (not shown) and the print cartridge 70. The cartridge electrical circuit 80 includes a plurality of cartridge contacts 82 that electrically communicate with a plurality of printer contacts (not shown) when the cartridge 70 is installed in a printer. The cartridge contacts 82 and printer contacts allow the printer to electrically communicate with the cartridge electrical circuit 80 to perform operational checks, print functions, and the like. While the illustrated example print cartridge 70 uses a flexible circuit, the present teachings may be applied to print cartridges 70 having other circuit configurations.

The illustrated print cartridge 70 is an ink jet cartridge and includes a housing 71, a cap 72 and an ink jet print head 73. The housing 71 includes a cartridge front face 76 to which a portion of the cartridge electrical circuit 80 is secured. The illustrated ink jet print head 73 includes an orifice plate 74 and ink jet nozzles 75. The illustrated print cartridge 70 further includes a silicon die (not shown) that may be located underneath the orifice plate 74.

The silicon die and/or the cartridge electrical circuit 80 may include cartridge memory. For example, the cartridge electrical circuit 80 may include memory in the form of first embedded memory arrays that are used to store printing parameters. These printing parameters may include any suitable information related to the print cartridge 70, such as production dates, ink container size, ink levels, age of the ink in the print cartridge, regional settings (e.g., United States or Europe) and a cartridge identification number, for example. Because the illustrated print cartridge 70 is an ink jet cartridge having an integrated print head 73, the cartridge contacts 82 also receive signals from the printer for operating the print head 73. Thus, the cartridge contacts 82 of the illustrated embodiment operate to provide the printer with information about the print cartridge 70 and to receive operating signals from the printer during print operations. Other cartridge embodiments may not include an integrated print head 73, in which case the cartridge contacts 82 may operate solely to exchange information signals with the printer to provide the printer with information about the print cartridge 70.

Each memory location in the first embedded memory arrays may include an electrical switch device, such as an electrical fuse or a field effect transistor (FET), for example. During the operating life of the print cartridge 70, an electrical signal may be sent to a particular memory location to program, burn, blow, or damage the electrical switch device, thereby rendering that particular memory location unable to be reset in the case of a one-time programmable memory. For example, when the ink in the print cartridge 70 is determined to have reached a minimum level of ink (e.g., it is depleted), the memory location that stores the ink level may be programmed (e.g., burned) so that if the print cartridge 70 is refilled with new ink, accurate information cannot be provided to the printer about the ink levels in the print cartridge 70. In other ink jet cartridges, the first embedded memory arrays may be reprogrammable or resettable memory arrays.

Figure 2:
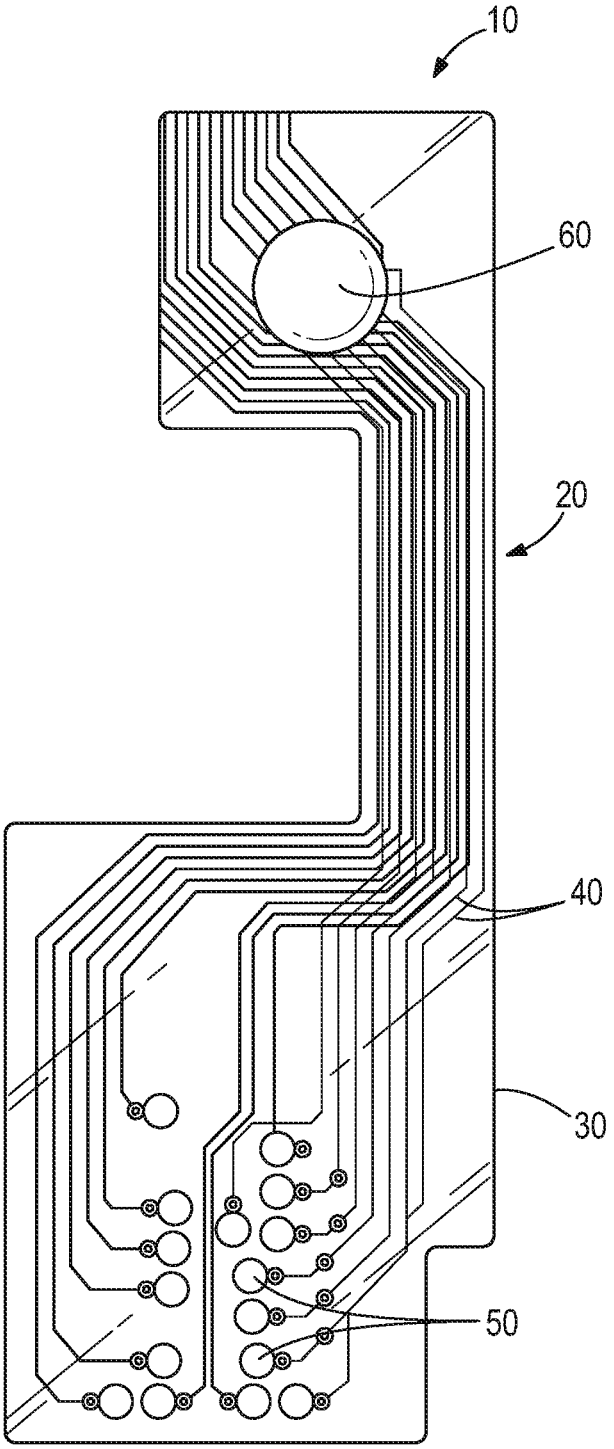
FIG. 2 is a front elevation view of a first embodiment of an electronic patch for a print cartridge.
Figure 3:
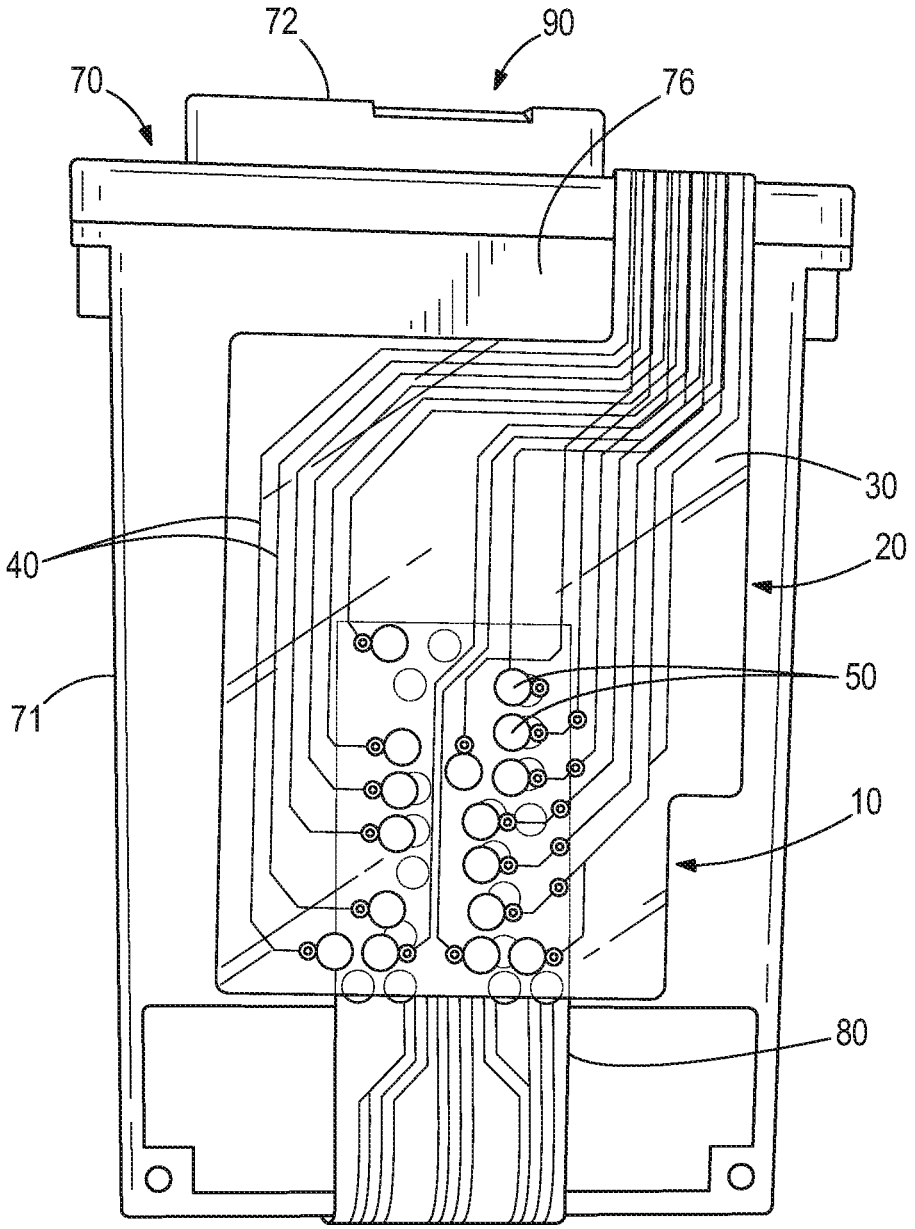
FIG. 3 is front elevation view of an embodiment of a print cartridge having an electronic patch attached thereto.
Figure 5:
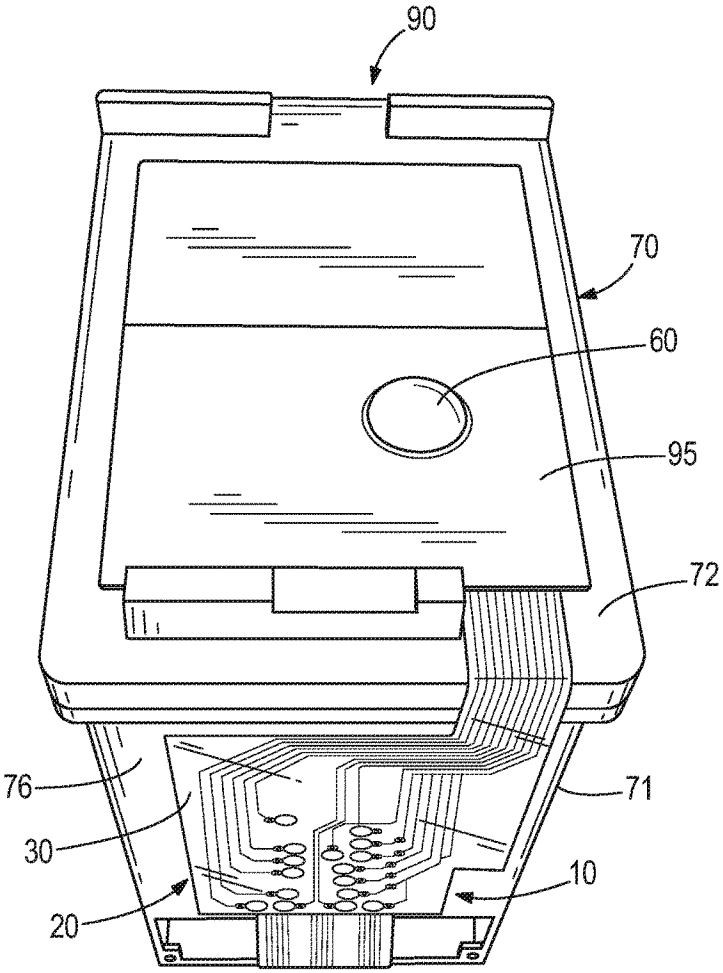
FIG. 5 is a top perspective view of the print cartridge of FIG. 3.

FIG. 2 illustrates a first embodiment of an electronic patch 10 for attachment to the print cartridge 70. FIGS. 3-7 illustrate the electronic patch 10 attached to the print cartridge 70 in order to create a refurbished or repaired print cartridge 90. Both the used print cartridge 70 and the refurbished print cartridge 90 may be configured to be used in the same printing device, such as a printer (not shown).

Alternatively, the used print cartridge 70 may be modified during remanufacturing such that the refurbished print cartridge 90 is compatible with a different printer device or devices other than the original use print cartridge 70.

Figure 4:
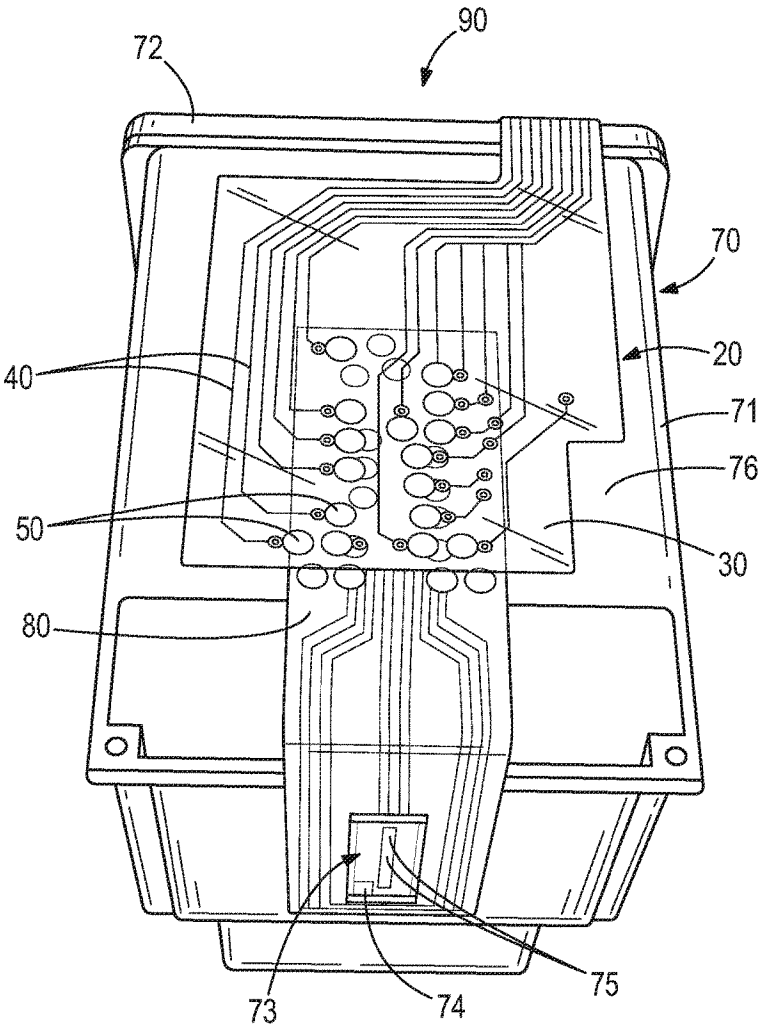
FIG. 4 is a bottom perspective view of the print cartridge of FIG. 3.
Figure 7:
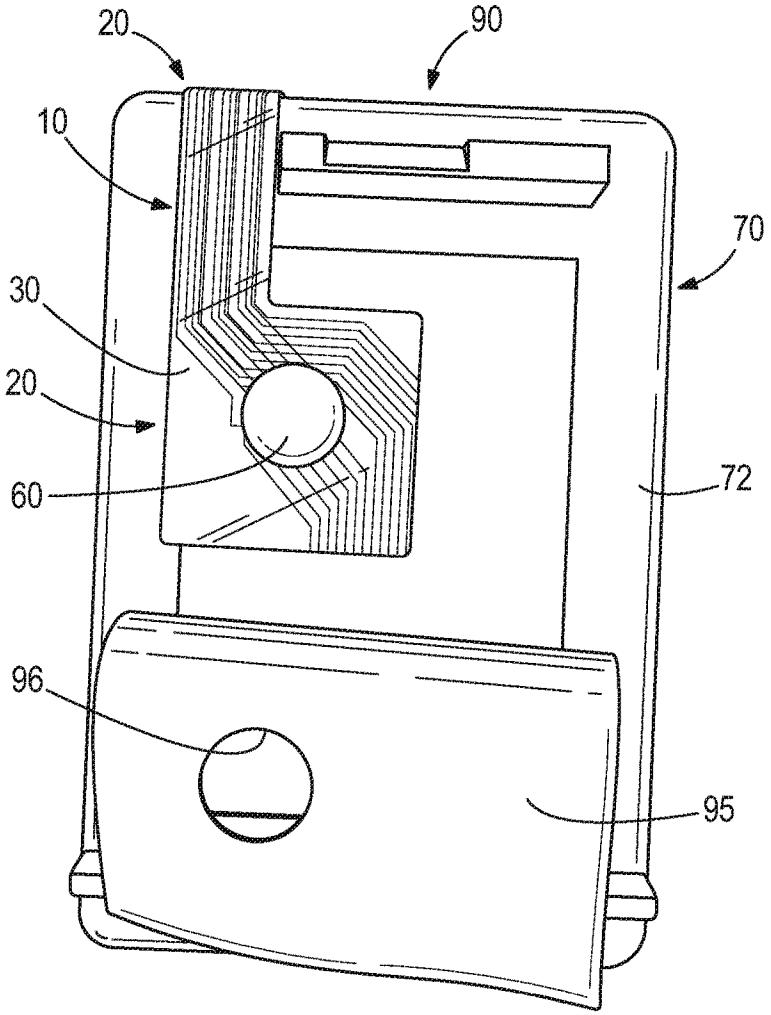
FIG. 7 is a top plan view of the print cartridge of FIG. 3 with the identification label partially removed.
Figure 6:
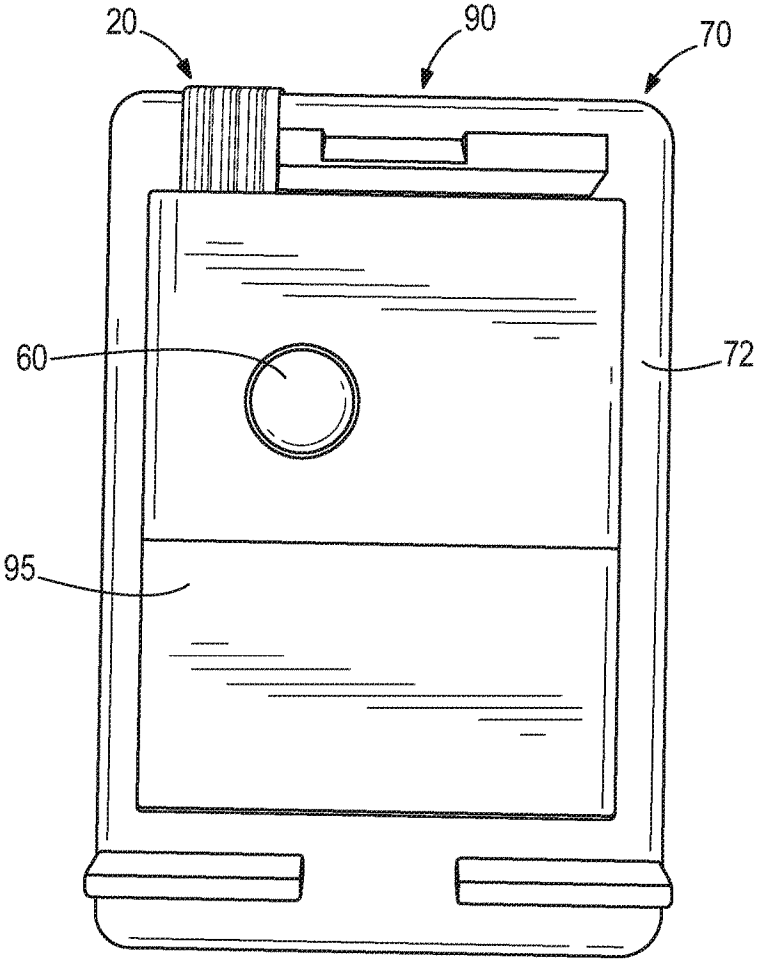
FIG. 6 is a top plan view of the print cartridge of FIG. 3.

In the illustrated embodiment, the electronic patch 10 includes a second circuit in the form of a replacement or patch circuit 20 configured to fit over a portion of the cartridge electrical circuit 80 on the used print cartridge 70. The patch circuit 20 includes a substrate 30, which in the illustrated construction comprises a flexible substrate, but which may also be or include a printed circuit board (PCB) substrate, or other suitable circuit substrate. The illustrated patch circuit 20 also includes a plurality of lead lines 40, a plurality of contact pads 50 and an integrated control chip 60. The patch circuit 20 and/or the integrated control chip 60 may include patch memory, which may be in the form of replacement or second embedded memory arrays. The patch substrate 30 may be formed from any suitable material, such as any type of polymer, for example. A substrate 30 that is flexible may be configured to flexibly align with the contours of the used print cartridge 70 to which it is attached. For example, a flexible substrate 30 may bend around a corner of the used print cartridge 70 as best shown in FIG. 4. As discussed further herein, other embodiments may include a substantially rigid substrate.

In the illustrated embodiment, the lead lines 40 and the contact pads 50 may be formed from any suitable conductive material, such as gold, copper or platinum, for example. The lead lines 40 and the contact pads 50 are configured to convey electrical signals from a printer controller (not shown) to the refurbished print cartridge 90, as well as to convey electrical signals from both the refurbished print cartridge 90 and the integrated control chip 60 to the printer controller. The electrical signals may be or include control or data signals for operation or diagnostics of the refurbished print cartridge 90. For example, some electrical signals may be used to control ink jet nozzles 75 in an orifice plate 74 of a refurbished ink jet print cartridge 90 (see FIG. 3).

The integrated control chip 60 may be any suitable electronic control device, such as a microcontroller, an application specific integrated circuit (ASIC) or a field programmable gate array (FPGA), for example. The integrated control chip 60 includes or communicates with the patch memory and may provide electrical signals to the printer corresponding to printing parameters such as ink levels, for example. The patch memory may be configured similarly to the cartridge memory, and may be provided with "one shot" electrical devices associated with each memory location (e.g., electrical fuse or FET), such that any of the replacement memory locations can be burned or damaged in a similar manner as the first embedded memory array locations of the print cartridge 70. Alternatively, the replacement embedded memory arrays may have any suitable multiuse electrical devices that may be switched and/or reset without damage to the memory location, such as resettable fuses or electrically erasable memory, for example. For example, when the ink of the refurbished print cartridge 90 reaches a minimum level or is depleted, the electrical control signal from the printer controller to program (e.g., burn) the memory location associated with the ink level may cause the multiuse electrical device to switch to an off state, thereby mimicking burning or damaging of the memory location and putting the memory location in a state that is temporarily unable to be reset. Upon refurbishing the refurbished print cartridge 90, the multiuse electrical device may be reprogrammed such that the memory location once again stores information relevant to the ink level of the re-refurbished print cartridge.

In the illustrated embodiment, the patch circuit 20 is positioned over a portion of the cartridge electrical circuit 80 such that some or all of the contact pads 50 are in contact with contact pads of the underlying cartridge electrical circuit 80. Some of the contact pads 50 may be configured as pass-through contacts that allow electrical signals to pass through to or from the electrically controlled elements of the print cartridge 70. For example, some contact pads 50 may be in pass-through contact with the underlying contact pads of the cartridge electrical circuit 80 that receive operating signals from the printer to control operation of the print head 73 and ink jet nozzles 75 of the print cartridge 70, thereby allowing the ink jet nozzles 75 of the refurbished print cartridge 90 to be controlled directly by the printer controller without any intervention or interference by the integrated control circuit 60. Although functioning in a pass-through manner, some of the pass-through contact pads may nonetheless communicate with the integrated control circuit 60 (e.g., via a wire trace 40) to allow the integrated control circuit 60 to monitor communication between the printer and the circuit 80. Other pass-through contact pads may not communicate in any manner with the integrated control circuit 60, and may simply function as a conductor for electrical signals between the printer and the circuit 80. Thus, the pass-through contact pads 50 may transmit operating signals and/or information signals between the printer and the cartridge electrical circuit 80.

Some contact pads 50 may be aligned with underlying contact pads of the cartridge electrical circuit 80 that are associated with the burned or damaged memory locations of the used print cartridge 70. These contact pads 50 may function as replacement contact pads and may be connected through lead lines 40 to the integrated control chip 60 such that an electrical signal that is intended for the contact pad of the cartridge electrical circuit 80 associated with a disabled memory location is re-routed to an appropriate portion of the integrated control chip 60, such as a replacement embedded memory location. For example, the printer controller may send an information signal in the form of a query regarding the level of ink in the refurbished print cartridge 90 to a contact pad associated with a non-functional memory location. In such instances, the electrical query signal may be re-routed to a corresponding embedded memory location in the integrated control chip 60 in which data corresponding to the current ink level value is stored. Because the integrated control chip 60 provides the printer controller with an appropriate response, the printer continues to function. In some embodiments, the replacement contact pads 50 of the patch circuit 20 may not be electrically connected with the contact pads associated with the burned or damaged memory locations of the used print cartridge 80 because the burned or damaged memory locations may be at least partially non-functional, making electrical connection therewith unnecessary.

In the embodiment of FIGS. 2-7, the patch circuit 20 is a flexible circuit and extends up the front and over onto the top of the used print cartridge 70. The integrated control chip 60 is positioned in the portion of the patch circuit 20 that is positioned on top of the used print cartridge 70. As shown in the illustrated embodiment, the integrated control chip 60 may be encased in a protective material, such as a moldable polymer, for example. Alternatively, the integrated control chip 60 may be partially or fully encased within the substrate 30. The refurbished print cartridge 90 may also include an identification label 95. In the embodiment of FIGS. 3-7, an identification label 95 is positioned on the cap 72 and over the portion of the patch circuit 20 in which the integrated control chip 60 is positioned. The label 95 may be provided with a hole 96 that accommodates the protective material surrounding the integrated control chip.

The patch circuit 20 may be attached to the used print cartridge 70 by any suitable attaching means. For example, portions of the substrate 30 may be coated or impregnated with an adhesive. Alternatively, portions of the used print cartridge 70 may be coated with an adhesive. In other embodiments, the contact pads 50 of the electronic patch 10 may include solder material on the side that mates to the corresponding contact pads on the used print cartridge 70, thereby allowing the contact pads 50 to be soldered to the contact pads on the used print cartridge 70. Other suitable attaching techniques may include overmolding, adhesive tape, ultrasonic welding, and the like, without limitation.

Figure 8:
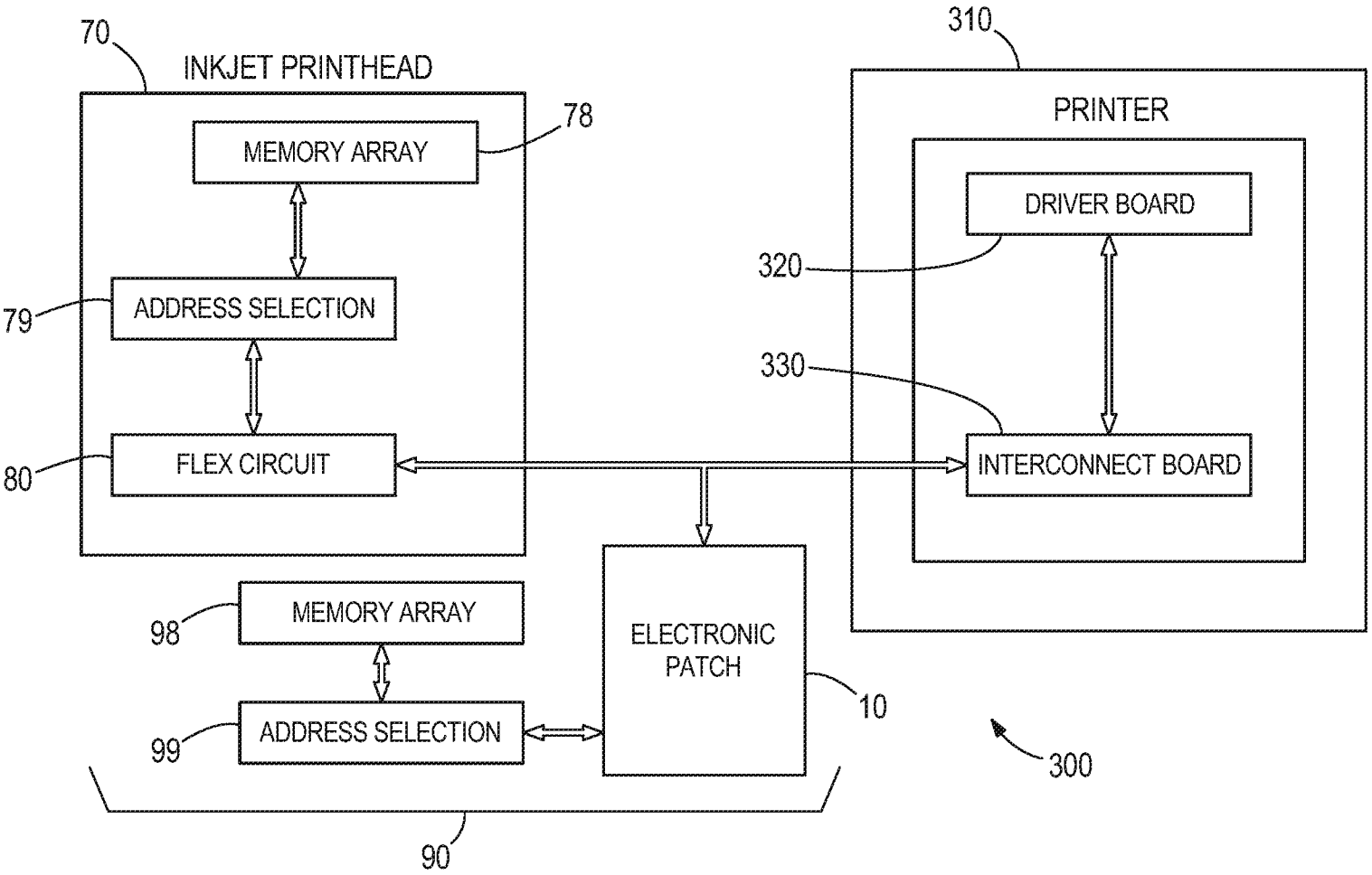
FIG. 8 is a block diagram of an embodiment of a printing system.

Referring to FIG. 8, an embodiment of a printing system 300 includes a printer 310 and a refurbished print cartridge 90. The printer 310 includes a driver board 320 and an interconnect board 330. The interconnect board 330 is in electrical communication with the driver board 320 and with the cartridge electrical circuit 80 of the print cartridge 70. The cartridge electrical circuit 80 is in electrical communication with a memory array 78 of the print cartridge 70 through an address selection section 79. The interconnect board 330 and the cartridge electrical circuit 80 are both in electrical communication with the electronic patch 10, which is in electrical communication with the memory array 98 of the electronic patch 10 through an address selection section 99. As noted above, some connections between the cartridge electrical circuit 80 and the electronic patch 10 may be pass-through connections that allow unrestricted communication between the printer 310 and the cartridge electrical circuit 80. Other connections between the cartridge electrical circuit 80 and the electronic patch may be replacement connections that re-route communications that would otherwise pass between the printer and the cartridge electrical circuit 80 such that those communications pass between the printer and the electronic patch 10.

Figure 9:
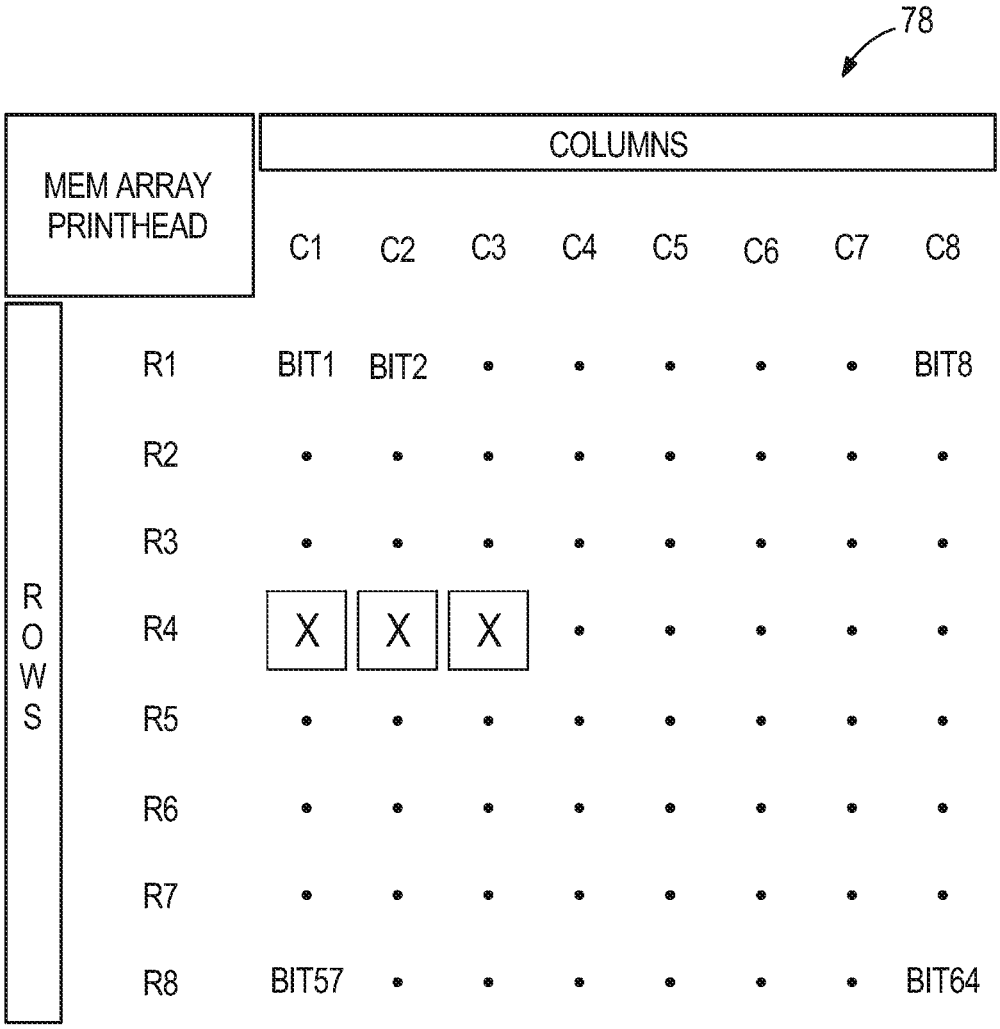
FIG. 9 is a block diagram of an embodiment of a used print cartridge memory array.

Referring to FIG. 9, the print cartridge memory array 78 is illustrated as a two dimensional array of rows and columns where each intersecting location of a row and a column is a specific memory location. As discussed above, particular memory locations may be programmed with an electrical signal to program, burn, or damage an electrical device associated with that memory location in order to render that memory location unable to provide accurate information to the printer for a refilled print cartridge. As illustrated in FIG. 9, the three particular memory locations at the intersections of row R4 and columns C1, C2 and C3 have been burned over the life cycle of the used print cartridge 70 and are no longer able to provide accurate information to the printer about a refilled print cartridge. For example, if these three memory locations are responsible for storing information regarding the ink levels of the print cartridge, they may provide information to the printer indicating that the print cartridge is empty or defective. This indication will be provided to the printer even if the print cartridge is refilled with printing ink, thereby causing the operation of the printer to stop or be inaccurate.

Figure 10:
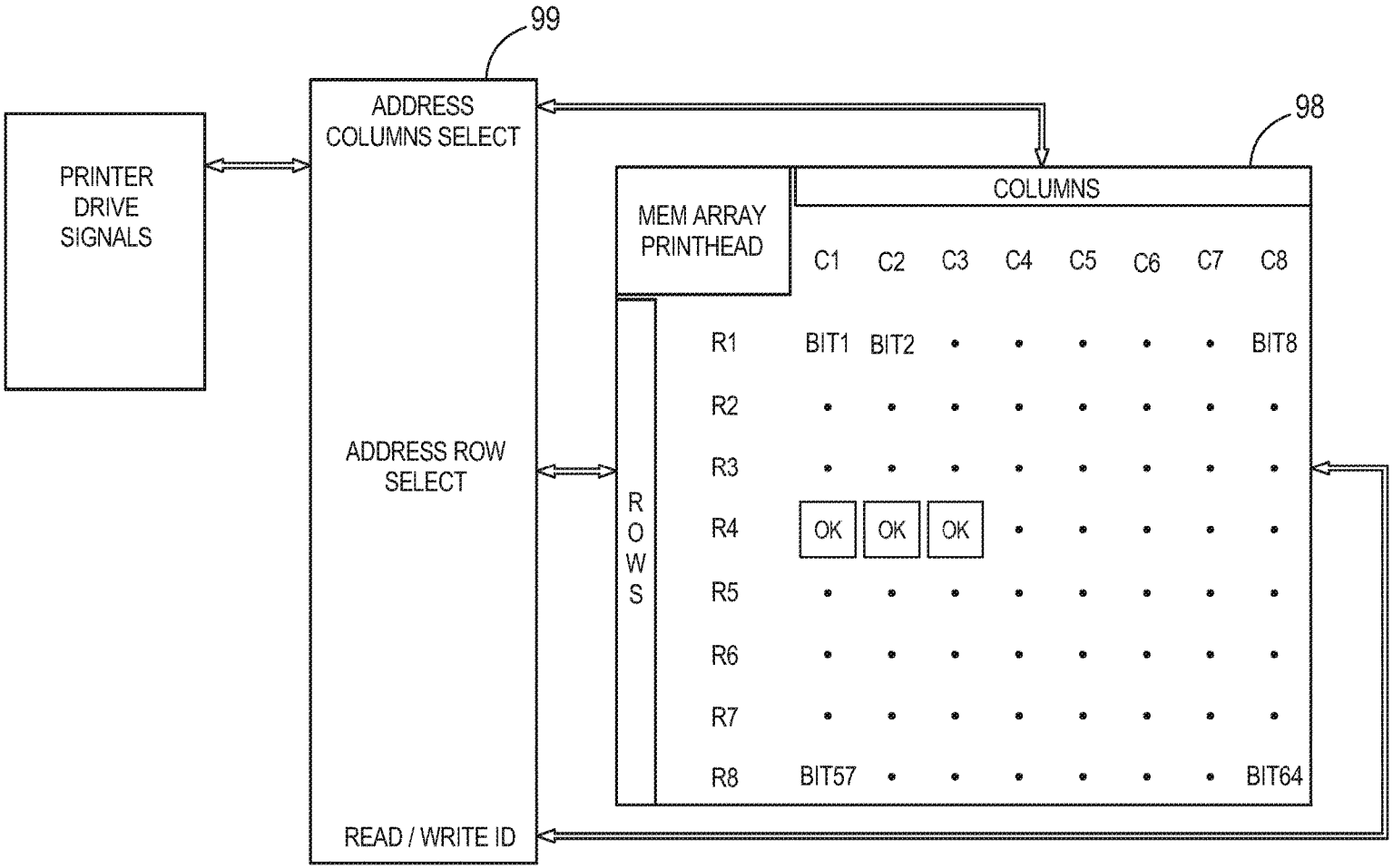
FIG. 10 is a block diagram of an embodiment of an electronic patch memory array.
Figure 11:
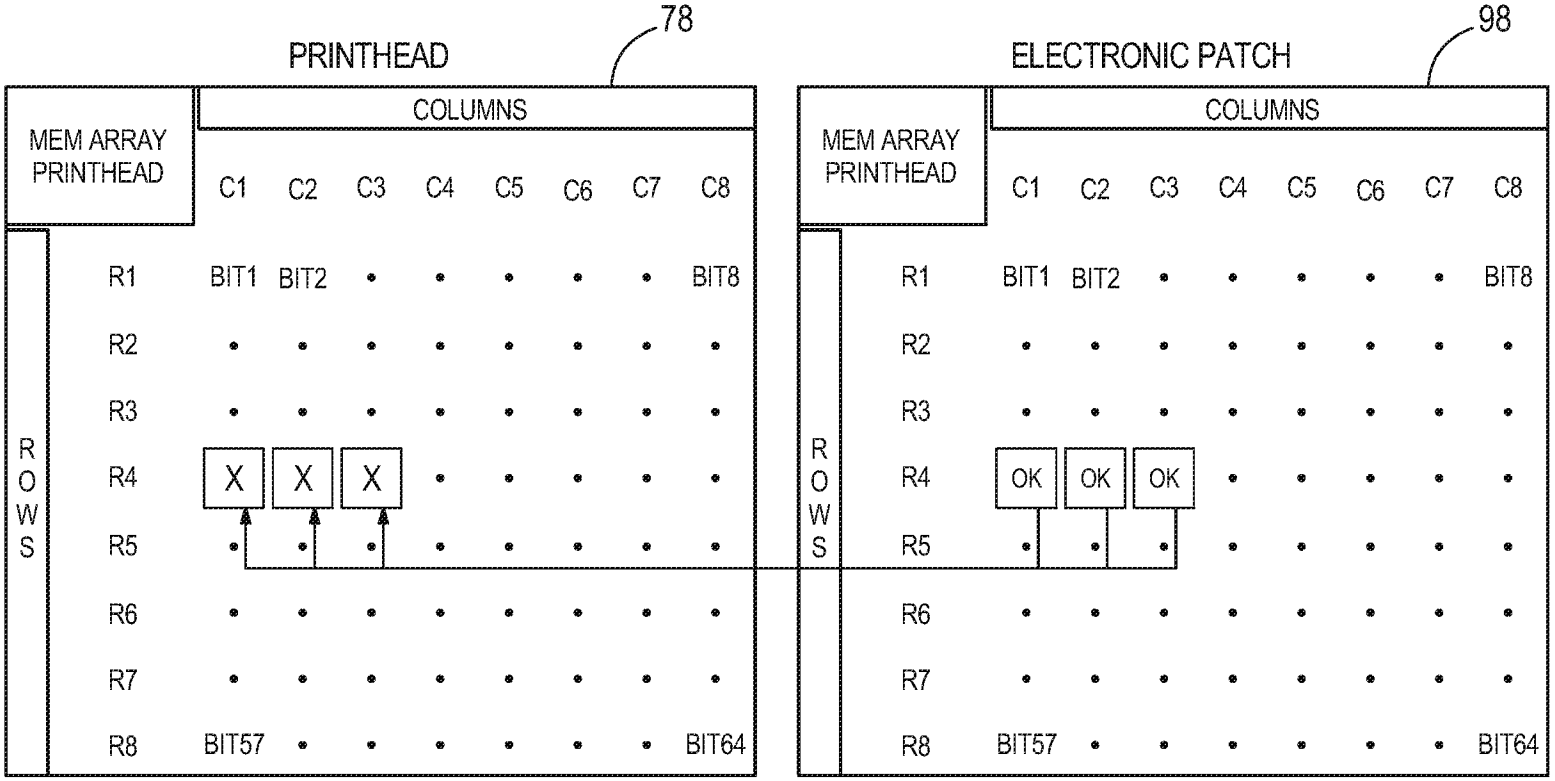
FIG. 11 is a block diagram mapping the electronic patch memory array of FIG. 10 to the used print cartridge memory array of FIG. 9.

Referring to FIGS. 10 and 11, the electronic patch memory array 98 is illustrated as a two dimensional array of rows and columns where each intersecting location of a row and a column is a specific memory location. These memory locations are mapped to the corresponding memory locations of the used print cartridge memory array 78. As illustrated in FIG. 10, the three particular memory locations at the intersections of row R4 and columns C1, C2 and C3 are usable memory locations, which are mapped directly to the corresponding burned memory locations in the used print cartridge memory array 78 as illustrated in FIG. 11. The usable memory locations of the electronic patch memory array 98 render the otherwise non-functional cartridge electrical circuit 80 functional, for example by providing ink level information to the printer. As a result, when the printer controller communicates with electronic patch memory array 98, operational data is returned to the print controller and the printer is allowed to perform print functions. This allows a depleted or used print cartridge 70 to be refilled with ink and repaired as a refurbished print cartridge 90 by adding the electronic patch 10, thereby saving on manufacturing costs and waste. In addition, when the refurbished print cartridge 90 is depleted, it may be refurbished yet again by either replacing the electronic patch 10 or by resetting the electrical switch devices in the memory arrays of the electronic patch 10. The electronic patch memory array 98 may be configured to reset and/or store any printing parameters, such as the production date, the ink container size, the age of the ink, the regional settings, the cartridge identification number and the ink levels, for example.

Figure 12:
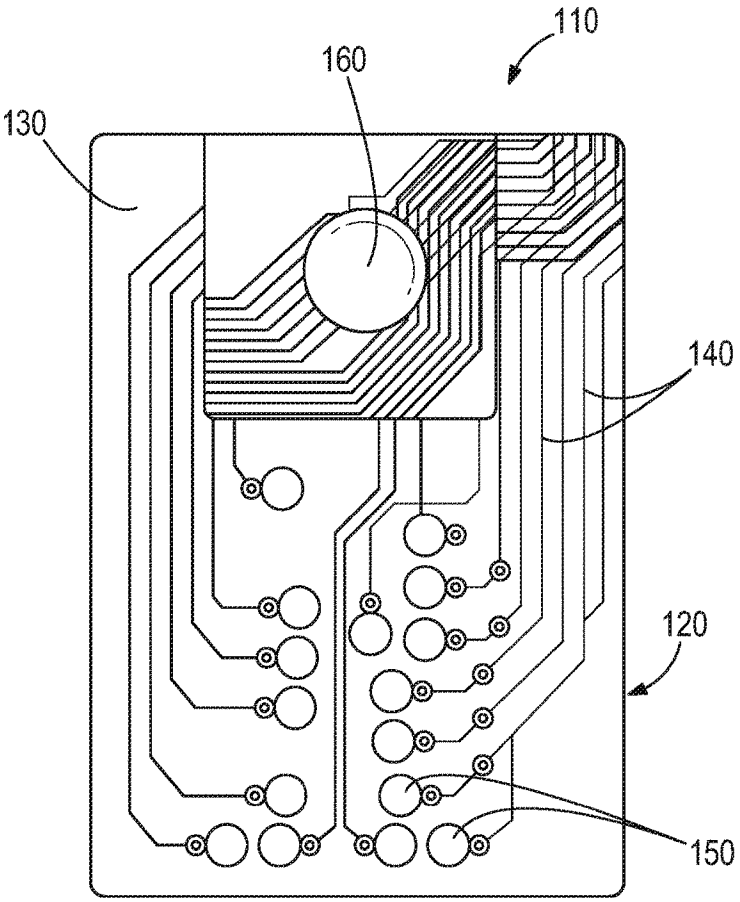
FIG. 12 is a front elevation view of a second embodiment of an electronic patch for a print cartridge.

FIG. 12 illustrates a second embodiment of an electronic patch 110. Electronic patch 110 includes a replacement circuit 120. The replacement circuit 120 includes a substrate 130, a plurality of lead lines 140, a plurality of contact pads 150 and an integrated control chip 160 with replacement or second embedded memory arrays. The electronic patch 110 is configured to be positioned entirely on the front face 76 of the used print cartridge 70, and therefore would not extend up the front face 76 and over onto the cap 72 as illustrated in the first embodiment discussed above. The electrical functions of the electronic patch 110 may be similar to the electrical functions of the electronic patch 10 discussed above.

Figure 13:
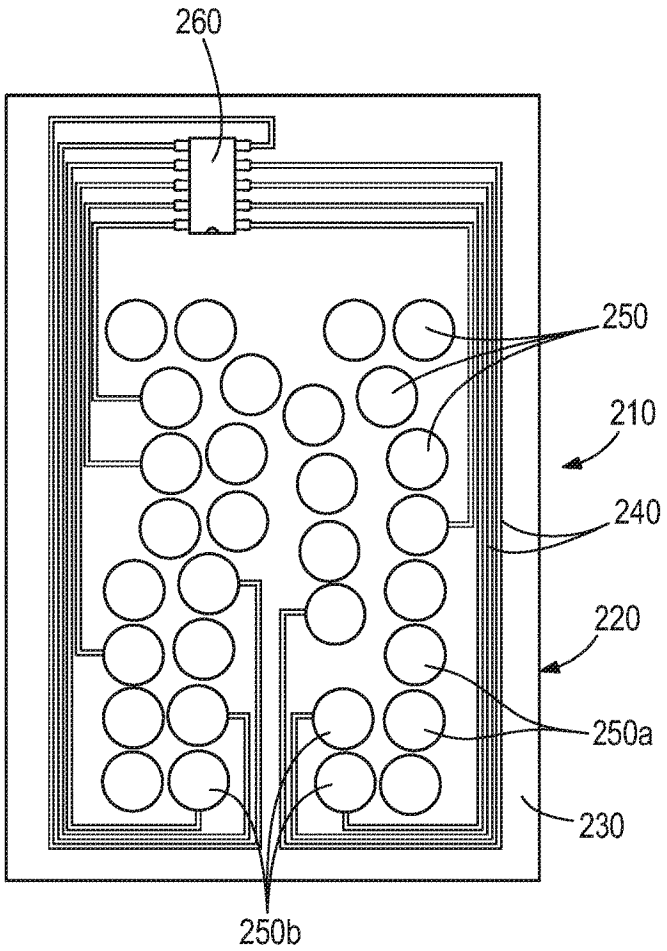
FIG. 13 is front elevation view of a third embodiment of an electronic patch for a print cartridge.

FIG. 13 illustrates a third embodiment of an electronic patch 210. Electronic patch 210 includes a replacement circuit 220. The replacement circuit 220 includes a substrate 230, a plurality of lead lines 240, a plurality of contact pads 250 and an integrated control chip 260 with replacement or second embedded memory arrays. The electronic patch 210 is configured to be positioned entirely on the front face 76 of the used print cartridge 70, and therefore would not extend up the front face 76 and over onto the cap 72 as illustrated in the first embodiment discussed above. The electrical functions of the electronic patch 210 may be similar to the electrical functions of the electronic patch 10 discussed above. FIG. 13 illustrates an embodiment having pass-through contact pads (e.g., pads 250*a*) that are not in communication with the integrated control chip 260, and replacement contact pads 250*b* that are in communication with the integrated control chip 260. It should be appreciated, however, that even though a contact pad 250 may have a lead line 240 electrically coupling it to the integrated control chip 260, that contact pad 250 may still function as a pass through contact pad, with the communication afforded by the lead line 240 being provided primarily or exclusively for purposes of monitoring communications between the printer and the cartridge electrical circuit 80.

Figure 15:
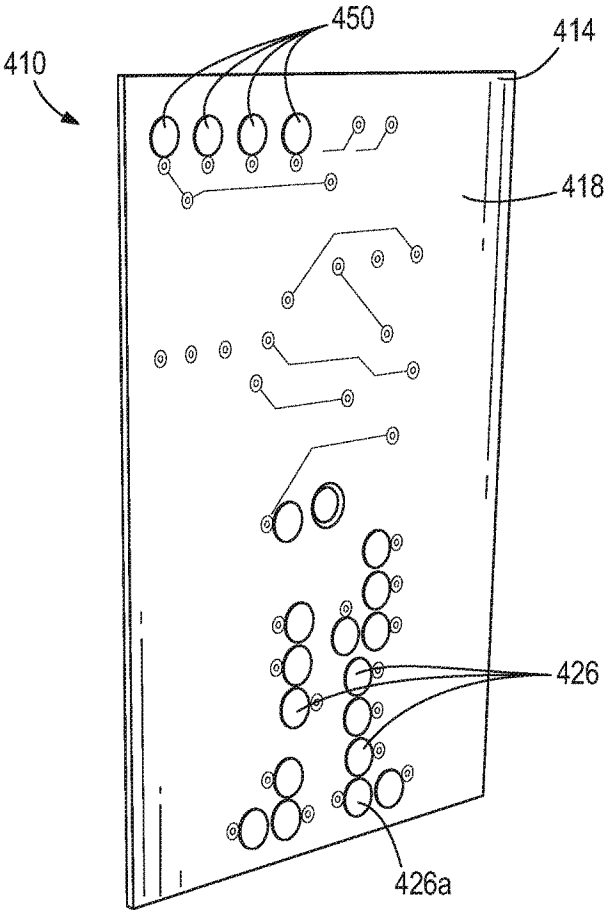
FIG. 15 is a front perspective view of the electronic patch of FIG. 14.
Figure 14:
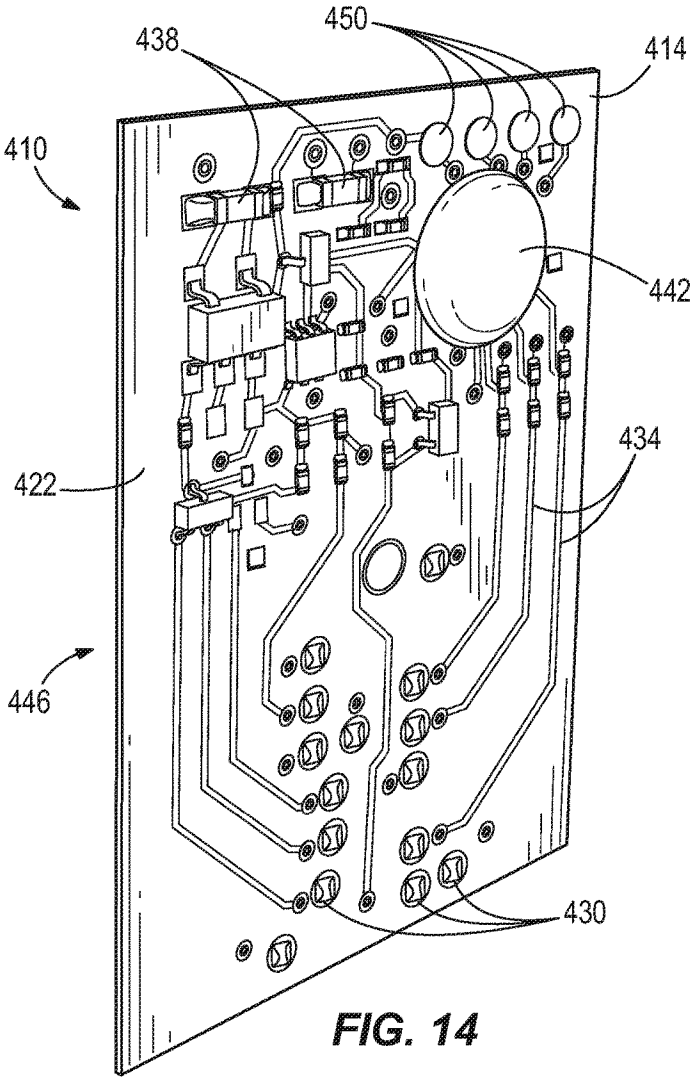
FIG. 14 is a rear perspective view of a fourth embodiment of an electronic patch for a print cartridge.

FIGS. 14 and 15 illustrate a fourth embodiment of an electronic patch 410 that includes a rigid substrate 414 having a front side 418 (FIG. 15) and a back side 422 (FIG. 14). The front side 418 is configured to face away from the print cartridge to which the electronic patch 410 is attached, and includes a plurality of contact pads 426 arranged for electrical engagement with electrical contacts of the printer into which the print cartridge and electronic patch are installed. The back side 422 faces toward and electrically couples with the print cartridge, as discussed further below. The back side 422 includes a plurality of solder locations 430 that are opposite and in electrical communication with the contact pads 426 on the front side 418 of the patch 410. The back side 422 also includes electrical traces 434 that extend between the solder locations 430 and a variety of circuit components 438. The circuit components 438 and traces 434 are also in electrical communication with an integrated control chip 442, which in the illustrated embodiment is encased in a dome of protective polymer material. In operation, the components provided on the substrate 414 define a replacement circuit 446 that renders an otherwise non-functional used printer cartridge functional, as discussed above.

Like the other exemplary embodiments, the embodiment of FIGS. 14 and 15 includes replacement contact pads and pass through contact pads. For example, contact pad 426*a* illustrates a replacement contact pad that is not electrically connected to the used print cartridge 70. More specifically, by comparing FIGS. 14 and 15, it can be seen that unlike the other contact pads 426, the replacement contact pad 426*a* does not have a corresponding solder location 430 for electrically coupling the contact pad 426*a* with a corresponding cartridge contact 82 on the used print cartridge 70. Although other configurations are possible, in many instances the replacement contact pad 426*a* is located to correspond with the location of a contact pad 82 on the used printer cartridge 70 associated with a non-functional memory location.

The electronic patch 410 also includes a plurality (e.g. four, as shown) of programming contact pads 450. The programming contact pads 450 communicate with the integrated control chip 442 but do not necessarily communicate with either the printer or the used print cartridge 70. The programming contact pads 450 may be used to program or reprogram the electronic patch 410. By way of example only, the electronic patch 410 may be programmed to operate with different types of printers or print cartridges, and may be programmed to reset and/or store printing parameters, such as the production date, ink container size, ink type, ink quantity, ink age, regional settings, the cartridge identification number, printer messaging parameters, and the like. Because the programming contact pads 450 are from the front side 418 of the patch 410, the patch 410 can be reprogrammed without removing the patch from the print cartridge. In this way, when a print cartridge already having a patch 410 attached thereto is depleted of ink and returned for remanufacturing, the patch 410 can be reprogrammed with appropriate information without removing the patch from the cartridge. In some embodiments, the patch may be reprogrammed by way of the contact pads 426, 426*a*, in which case the contact pads 426, 426*a* also comprise programming contact pads 450.

Figure 16:
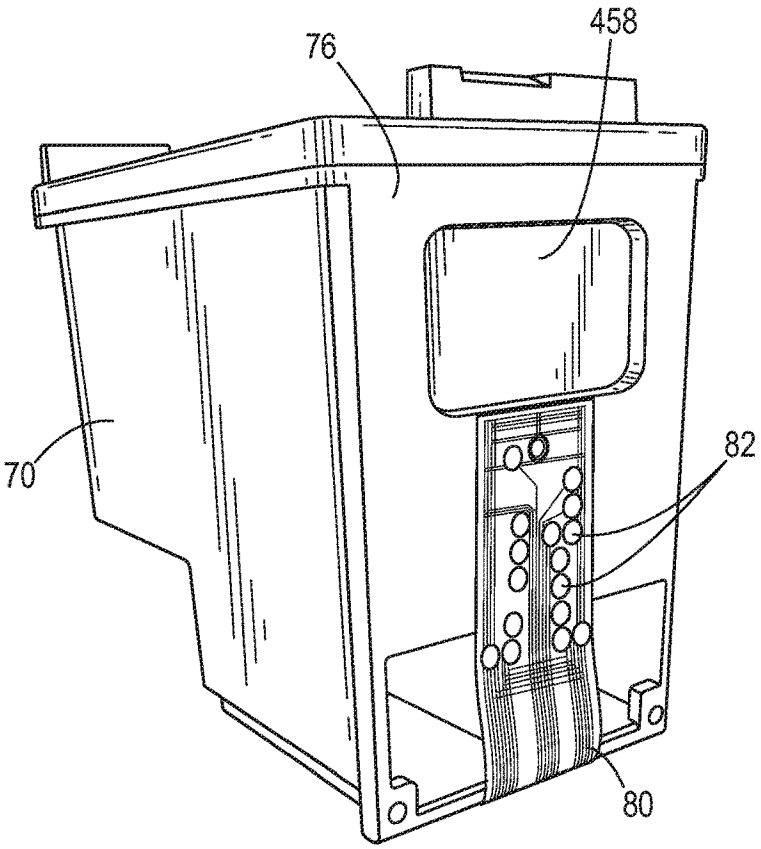
FIG. 16 is a front perspective view of a used print cartridge that has been modified to accept the electronic patch of FIG. 14.

FIG. 16 illustrates a used print cartridge 70 that has been modified to accept the electronic patch 410. More specifically, a portion of the front face 76 of the print cartridge 70 has been removed to define a recess 458 sized and positioned to receive the integrated control chip 442 on the back side 422 of the electronic patch 410. By way of example only, the recess 458 may be formed in the area above the cartridge contacts 82. The recess 458 may be formed using an end mill or other any suitable material removal technique. The recess 458 allows the electronic patch 410 to sit substantially level with the front face 76 of the cartridge 70 when the patch 410 is attached to the cartridge 410.

Figure 17:
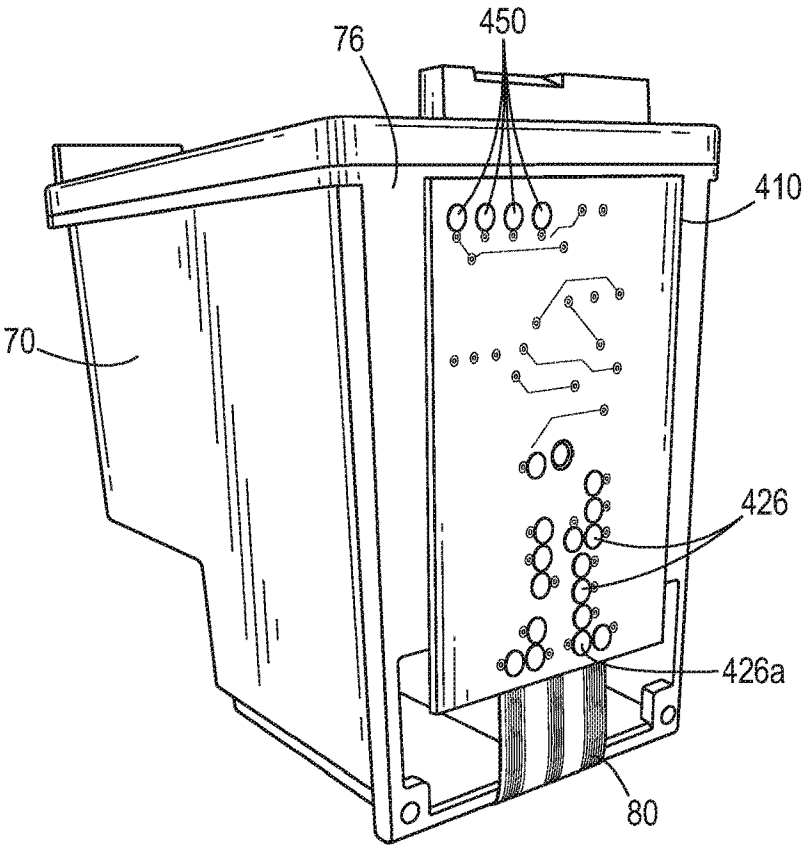
FIG. 17 is a front perspective view of a remanufactured print cartridge comprising the used print cartridge FIG. 16 and the electronic patch of FIG. 14.

FIG. 17 illustrates the electronic patch 410 attached to the print cartridge 70 that has been modified with the recess 458. As shown, the patch contact pads 426, 426*a* are positioned over respective cartridge contacts 82 and, with the exception of the contact pad 426*a*, electrically communicate therewith. Although other methods may be used, in the illustrated embodiment, the patch 410 is soldered to the print cartridge 70 by way of the solder locations 430 provided on the back side 422 of the substrate 414. To solder the patch 410 to the print cartridge 70, the cartridge 70 and the patch 410 may be fixtured such that the solder locations 430 are aligned and in contact with their respective cartridge contacts 82. A heated die may then be urged against the patch contact pads 426, 426*a*, simultaneously applying heat and pressure to the contact pads 426, 426*a*. The contact pads 426, 426*a* conduct heat from the die to the solder locations 430 until the solder at the solder locations 430 melts and flows over the cartridge contacts 82. The heated die can then be removed, allowing the solder to cool and solidify and thereby bonding the patch 410 to the print cartridge 70. The solder locations 430 thus electrically and mechanically couple the patch 410 to the cartridge 70. In some embodiments, the solder locations 430 may be the only mechanism by which the patch 410 is mechanically coupled to the cartridge 70.

In some embodiments, the electronic patch 410 may be programmed to interact with the printer in a way that causes the printer to generate certain messages to the user when a print cartridge carrying the electronic patch 410 is inserted into the printer. Messages to the user may be displayed on an LCD display built into the printer, or may be displayed on a computer monitor associated with the computer from which the user is printing. By way of example only, the electronic patch 410 may be programmed to cause the printer to generate a message to the user that indicates that a "Genuine OEM" cartridge has been installed in the printer. In some printer types, a "Genuine OEM" message may be required in order to gain access to all available printer functions, and to eliminate annoying pop-up messages during operation. The electronic patch 410 may alternatively be programmed to cause the printer to generate a "used genuine OEM" message, a "non-OEM supply" message, or other messages that are generally defined by firmware residing within the printer controller.

A used or depleted print cartridge 70 may be refurbished into print cartridge 90 for reuse in a printer. The refurbishing process may include cleaning the used print cartridge 70 and refilling the used print cartridge 70 with the appropriate printing ink. The refurbishing process may also include positioning and attaching an electronic patch 10, 110, 210, 410 over a portion of the cartridge electrical circuit 80 on the used print cartridge 70, so that the contact pads 50 and solder locations 430 on the replacement circuit 20, 120, 220, 446 are in electrical contact with the appropriate corresponding contact pads 82 of the cartridge electrical circuit 80. The refurbishing process may further include positioning and attaching an identification label 95 on the used print cartridge 70. The refurbishing process may also include testing the refurbished print cartridge 90 for proper operation. The refurbishing process may further include resetting or storing at least one of the production date, the ink container size, the age of the ink, the regional settings, the cartridge identification number and the ink levels.

The refurbishing process provides for re-using a used print cartridge 70 in which one or more memory arrays are permanently damaged. Alternatively, the electronic patch 10, 110, 210, 410 may be used to refurbish a used print cartridge 70 that has resettable or reprogrammable memory arrays. Here the electronic patch 10, 110, 210, 410 provides for re-using the used print cartridge 70 without having to reprogram or reset the original memory arrays, but instead provides the same override signals as for a single shot memory array. In other words, the reprogrammable or resettable memory locations in the used print cartridge 70 that have been programmed to mimic a burned or destroyed memory location are left in that state and the corresponding memory locations in the electronic patch 10, 110, 210, 410 are used to replace these switched off memory locations. For example, it may require expensive equipment to reset or reprogram a used print cartridge 70 having resettable or reprogrammable memory locations, or the resetting functions may be encrypted or locked. Thus, it may be more efficient or cost effective to refurbish the used print cartridge 70 using the electronic patch 10, 110, 210, 410 instead.

One concern of the remanufacturing industry is the ability of OEM print manufacturers to change or update the firmware on their printers. The electronic patches 10, 110, 210, and 410, by virtue of their ability to be reprogrammed, may provide remanufacturers with enhanced flexibility for responding to OEM firmware updates. In some manufacturing environments, electronic patches 410 may be programmed "in line" as part of the manufacturing process, thereby allowing for rapid changes in the programming of the electronic patches 410 in response to OEM firmware updates.

While specific embodiments have been illustrated and described, numerous modifications come to mind without significantly departing from the spirit of the disclosure, and the scope of protection is to be limited only by the scope of the accompanying claims.

What is claimed is:

1. A method of operating a remanufactured print cartridge, the remanufactured print cartridge having a print head, a cartridge circuit with at least one non-functional circuit element, and an electronic patch assembly added to the print cartridge during remanufacturing, the electronic patch assembly including a replacement circuit element for replacing the at least one non-functional circuit element of the cartridge circuit, the method comprising:

receiving information signals from a printing device;

routing the information signals to the replacement circuit element;

receiving operating signals associated with operation of the print head from the printing device; and operating the print head in response to the operating signals without intervention by the electronic patch assembly.

2. The method of claim 1, wherein the electronic patch assembly includes patch contact pads and the cartridge circuit includes cartridge contact pads, and wherein routing the information signals to the replacement circuit element includes electrically connecting at least some of the patch contact pads with at least some of the cartridge contact pads.

3. The method of claim 1, further comprising the replacement circuit element responding to the information signals.

4. The method of claim 1, wherein the electronic patch assembly is positioned over at least a portion of the cartridge circuit such that receiving operating signals associated with operation of the print head from the printing device includes receiving operating signals via the electronic patch and passing the operating signals to the cartridge circuit.

5. The method of claim 1, wherein the electronic patch assembly includes patch contact pads in communication with cartridge contact pads, and wherein receiving operating signals associated with operation of the print head from the printing device includes receiving operating signals via the patch contact pads and passing the operating signals through to the cartridge contact pads.

6. The method of claim 1, wherein the replacement circuit element includes an integrated control circuit, and wherein routing the information signals to the replacement circuit element includes routing the information signals to the integrated control circuit.

7. The method of claim 1, further comprising resetting the electronic patch assembly after the remanufactured print cartridge has been depleted.

8. The method of claim 7, wherein the electronic patch assembly includes memory arrays comprising electrical switch devices, and wherein resetting the electronic patch assembly includes resetting the electrical switch devices.

9. The method of claim 1, wherein receiving information signals from the printing device includes receiving information signals associated with an ink level query.

10. The method of claim 8, wherein routing the information signals to the replacement circuit element includes routing information signals associated with the ink level query.

11. The method of claim 8, further comprising the replacement circuit element responding to the information signals associated with the ink level query to provide ink level information to the printing device.

12. A method of operating a remanufactured print cartridge, the remanufactured print cartridge having a print head, a cartridge circuit including cartridge contact pads and at least one non-functional circuit element, the remanufactured print cartridge also having an electronic patch assembly added to the print cartridge during remanufacturing, the electronic patch assembly including patch contact pads, at least some of which are in electrical communication with at least some of the cartridge contact pads, and a replacement circuit element for replacing the at least one non-functional circuit element of the cartridge circuit, the method comprising:

receiving information signals associated with an ink level query from a printing device;

routing the information signals associated with the ink level query to the replacement circuit element via the patch contact pads;

responding, with the replacement circuit element, to the information signals associated with the ink level query to provide ink level information to the printing device;

receiving operating signals associated with operation of the print head from the printing device; and operating the print head in response to the operating signals without intervention by the electronic patch assembly.

13. The method of claim 12, wherein receiving operating signals associated with operation of the print head from the printing device includes receiving operating signals via the patch contact pads and passing the operating signals through to the cartridge contact pads.

14. The method of claim 12, wherein the replacement circuit element includes an integrated control circuit, and wherein routing the information signals associated with the ink level query to the replacement circuit element includes routing the information signals to the integrated control circuit.

15. The method of claim 12, further comprising resetting the electronic patch assembly after the remanufactured print cartridge has been depleted.

16. The method of claim 15, wherein the electronic patch assembly includes memory arrays comprising electrical switch devices, and wherein resetting the electronic patch assembly includes resetting the electrical switch devices.

* * * * *